United States Patent [19]

Csoka

[11] 4,057,253

[45] Nov. 8, 1977

[54] MAZE BOARD GAME APPARATUS

[75] Inventor: Frank S. Csoka, Sea Cliff, N.Y.

[73] Assignee: Fun Things, Inc., New York, N.Y.

[21] Appl. No.: 724,865

[22] Filed: Sept. 17, 1976

[51] Int. Cl.[2] ..... A63F 3/00

[52] U.S. Cl. ..... 273/131 BA; 273/130 F; 273/130 G; 273/136 E; 273/137 AC; 273/153 R

[58] Field of Search ..... 273/130, 131, 136

[56] References Cited

U.S. PATENT DOCUMENTS

| | | | |
|---|---|---|---|
| 1,666,359 | 4/1928 | Steves | 273/136 E |
| 3,768,811 | 10/1973 | Goldfarb | 273/131 BA X |

FOREIGN PATENT DOCUMENTS

| | | | |
|---|---|---|---|
| 104,092 | 2/1917 | United Kingdom | 273/131 B |
| 1,103,337 | 2/1968 | United Kingdom | 273/130 F |

*Primary Examiner*—Delbert B. Lowe

*Attorney, Agent, or Firm*—Marvin Feldman; Stephen E. Feldman

[57] ABSTRACT

A maze game having a plurality of game boards, each game board comprising individually identified delineated boxes, and grooves disposed peripherally of and between the boxes, and a plurality of walls insertable into the grooves between each set of adjacent boxes so as to form a wall therebetween, and wherein a series of such walls defines a maze on the board, and a token piece for moving step-wise from one box to an adjacent box through the maze as it is being defined, and a plurality of game sheets having like individually identified delineated boxes corresponding to the game board for each player to define a maze thereon without disclosure to the other player. The object of the game is to move the token piece step-wise on one player's board though the secreted maze configuration to the secreted end-square of the other player, before the other player defines the secreted maze configuration of the first player.

15 Claims, 4 Drawing Figures

MAZE BOARD GAME APPARATUS

This invention relates to a board game. Specifically, this invention relates to a board game wherein a player must reach the end of a maze as the secreted maze is being defined on the game board.

Heretofore maze puzzles involved a prescribed maze arrangement wherein a player must advance from the start through the maze to the prescribed finish; the player viewing the maze from the start.

Now there is provided by the present invention a game wherein one player must in a step-wise manner define on a game board the other player's secreted maze before the said other player defines the first player's secreted maze.

It is therefore an object of this invention to provide a game having a game board circumscribing a plurality of regions, and the board is formed so as to secure a plurality of partitions between the regions so as to define a maze pattern on the board.

It is another object of this invention to provide a game as aforesaid wherein there are two game boards and two sheets showing corresponding regions of the game board, said sheets for ascribing a secreted maze thereon; the game sheets being used in conjunction with the game boards by opposing players, and wherein one player seeks to define the secreted maze of the other player on one game board before the other player defines the secreted maze of the first player on the other game board.

It is still a further object of this invention to provide a game as aforesaid wherein the partitions are removably insertable in the game board.

It is a still further object of this invention to provide a game as aforesaid wherein a token piece indicates the position of advancement of the player as the maze is being defined on the game board.

The aforesaid as well as other objects and advantages of the invention will appear hereinafter from the following description taken in connection with the accompanying drawings in which:

FIG 1. is a perspective view of the game board of the invention as the game is in progress for a first player;

Figure 1:
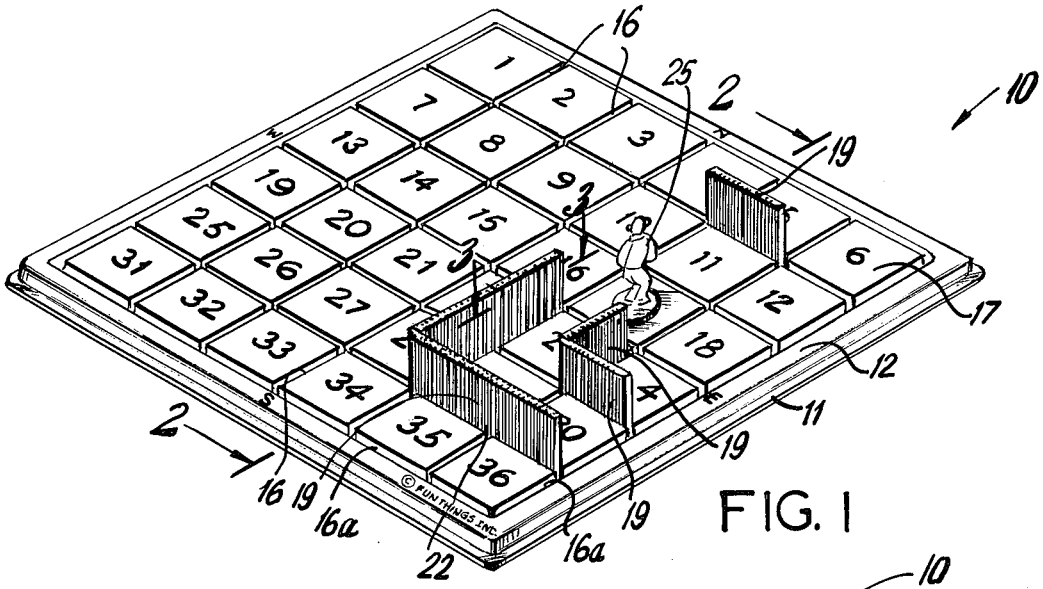
Figure 2:
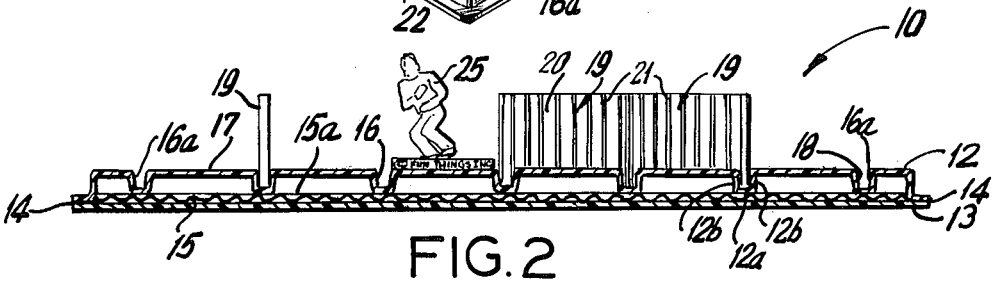
FIG. 2 is an enlarged sectional view taken along line 2—2 of FIG. 1.
Figure 3:
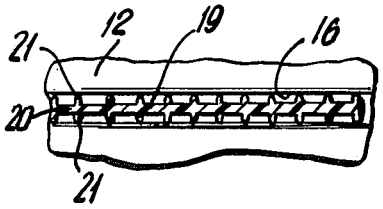
FIG. 3 is an enlarged partial sectional view taken along line 3—3 of FIG. 1.

Referring to FIGS. 1-3 there is shown the game of this invention generally referred to as numeral 10. Game 10 comprises a game board 11, comprising a plastic top member 12, a plastic bottom member 13 sealed to the top 12 at the peripheral edges 14, and a corrugated cardboard support member 15 disposed between top 12 and bottom 13. Top member 12 is a thermoformed plastic sheet formed with a plurality of grooves 16, said grooves intersecting in a rectilinear manner so as to form thirty six boxes 17 (typical); the boxes being identified by numerals 1-36 in seriatim. In addition to the grooves 16 formed between the boxes 17, grooves 16a are also formed in top 12 so as to peripherally circumscribe the boxes.

Each groove 16 and **16*a* is formed with a downward taper 18. The bottom surface 12*a* of top 12 which forms the grooves (16, 16*a*) contacts the top 15*a* of support member 15, but the side surfaces 12*b*** are free to flex outwardly.

Game 10 is also provided with a plurality of partitions or walls 19 for insertion into grooves **16, 16*a*. Each wall 19 is formed of a one-piece, injection molded member having a central portion 20 formed with a series of outwardly extending oppositely disposed, tapered ribs 21. Central portion 20 is sized so as to extend the full length of each box 17. Partitions inserted in adjacent boxes are abutting so as to form a contiguous wall as shown at 22. The ribs 21 are tapered so as to provide some flexibility when the partition is pressfitted into the groove, and the groove itself has some flexibility as hereinbefore described. In this manner of construction, the partitions 19 may be readily and repeatedly inserted into and removed from the grooves 16, 16*a*** without damage to the board or partition, and yet retain a vertically upright position when inserted.

A token piece 25 in the form of a figure is provided for use with each game board 11 so as to denote the position (i.e. box) which the player has achieved enroute to the end-square of the other player's secreted maze. Token piece 25 is sized to fit within each box 17.

Figure 4:
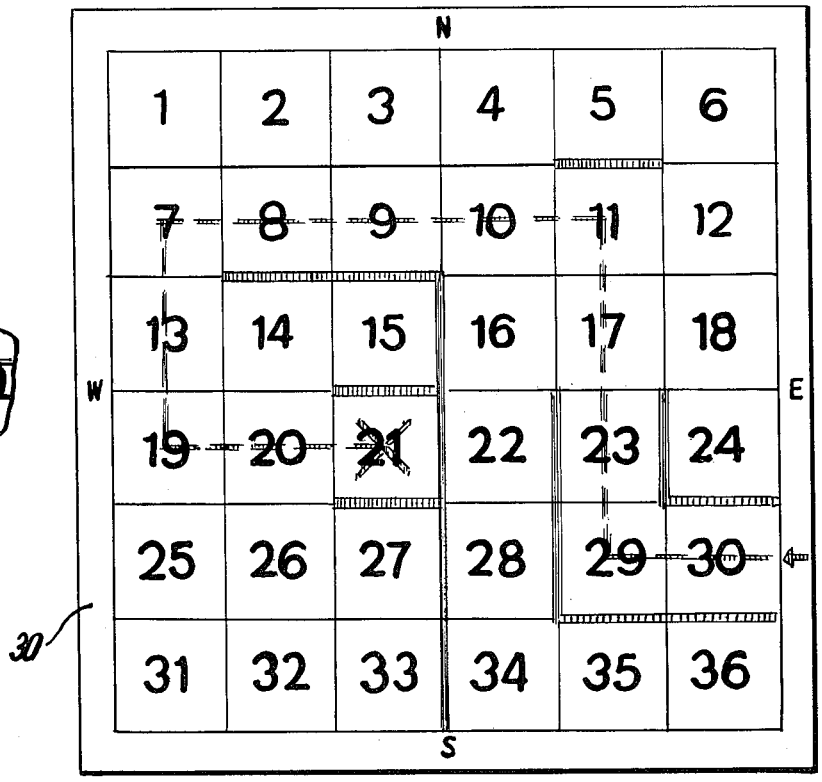
FIG. 4 is a top plan view of a sheet depicting the game board configuration and having the secreted maze configuration of the second player in red thereon.

Referring to FIG. 4, there is shown a sheet of paper 30 having the board arrangement of top 12 depicted thereon. Specifically a series of 36 boxes are imprinted on each sheet and the letters, "N, E, W and S" (representing North, East, West and South, respectively) are also imprinted thereon for purposes hereinafter appearing. Further, FIG. 4 depicts (in red) the secreted maze of the other player, including the end-square or box "21" which is marked in red and the entry square or box "30" which is marked by an arrow (in red).

The game 10 of this invention generally includes two boards; a plurality of partitions sufficient to construct separate mazes for each board; two token pieces; and two pads of a large plurality of sheets of paper for numerous games.

With the aforesaid construction the game is played as follows:

Each player is provided with his own maze board 11, a pad of maze sheets 30, a red pencil for drawing the maze, a token piece 25 to move from box to box in the maze board; and a plurality of partitions. Actually the partitions are in a central bin from which each player takes partitions as needed as the game progresses.

The game begins with each player drawing his own maze on a maze blank, which he conceals from the opposing player. An entry square is chosen and marked with an arrow, and an end-square is chosen and marked with an "X". A broken line is then drawn from the arrow to the designated end-square along any desired route. Only an outside square (i.e., "1, 2, 3, 4, 5, 6, 12, 18, 24, 30, 36, 35, 34, 33, 32, 31, 25, 19, 13 or 7") can be an entry square, but any square, except the specifically selected entry square, can be an end-square. After the broken line maze is drawn, a series of solid lines depicting walls are drawn which will block off the maze path from the other squares. While there may be many paths to the end-square, generally the opponent is to be made to travel along any path leading to the end-square, without crossing squares where a wall has been designated. Obviously, once the maze is drawn it may not be altered.

The play begins with the first player attempting to guess the entry square. The players in order take turns, and assuming Player 1 has drawn the maze of FIG. 4 and Player 2 is operating on the board of FIG. 1, there is a typical colloquy, as for example:

Player 1: "Is the entry square on the North side?"

Player 2: "No."

Having guessed wrong, Player 1 loses his turn. A player may continue to guess and keep his turn as long as he is correct. He loses his turn when he gets "no" for an answer.

Player 2: "Is the entry square on the East side?"

Player 1: "Yes."

(Having guessed the section of the board in which his opponent has placed the entry square, the player continues his turn, trying, now, to guess the exact square of entry.)

Player 2: "May I enter the maze on square 12?"

Player 1: "No."

(Player 2 puts up a wall on the outer slot of square 12. Wall not shown in FIGS.)

Once a player correctly guesses the entry square . . .

Player 2: "May I enter the maze on square 30?"

Player 1: "Yes."

. . . he places his man upon the square, and tries to guess the true path of the maze. He makes as many guesses in succession as he can, moving his man from square to square. He must move only one square at a time, and may only move to a square next to the one he is on in any direction but never diagonally. He continues to move (even retracing his steps, if necessary) until he is blocked by a wall. Then it is his opponent's turn.

FIG. 4 depicts the game board of Player 2 at a more advanced stage of play.

It is to be borne in mind that the walls may be drawn so that the player is free to pass from square to square in a direction away from the end-square. Often it is only until a player realizes he is in a cul-de-sac that he realizes he has been so misled.

While the game board depicted shows thirty-six squares, other pluralities of boxes or squares may be employed if desired. However, it has been found that 36 boxes represent a level of difficulty lending challenge to the game without providing an unduly long period of play.

While in the foregoing there have been described and shown the preferred embodiments of the invention, various modifications may become apparent to those skilled in the art to which the invention relates.

What is claimed is:

1. A maze game comprising a game board formed with a plurality of means to receive a partition, said means being formed so as to define a plurality of regions, each region being indentified by a specific distinguishing character, and a plurality of partitions each of said partitions being formed so as to be removably insertable into said game board means between adjacent regions so that the inserted partition is disposed therein, wherein a plurality of inserted partitions defines a maze on the game board, further comprising a plurality of surfaces, each surface having the pattern defining the plurality of regions as shown on the game board.

2. The maze game of claim 1, wherein the partition receiving means comprises a groove formed in the board.

3. The maze game of claim 1, said board comprising a molded plastic sheet and wherein said partition receiving means are formed in the sheet.

4. The maze game of claim 3, wherein said partition receiving means are grooves in the plastic sheet, and wherein said partitions press-fit into the grooves.

5. The maze game of claim 4, wherein each of said partitions comprises a plastic member formed with a plurality of outwardly extending ribs on opposite sides of the member, and wherein the outward ends of the ribs contactingly engage the walls of said grooves.

6. The maze game of claim 5, wherein each of said partitions is a one-piece molded product.

7. The maze game of claim 5, wherein said grooves are tapered and wherein the plastic sheet forming the grooves and the outward ribs of the partitions are sufficiently flexible so that the partitions are insertable therein.

8. The maze game of claim 1, wherein said partition receiving means define a plurality of 36 boxes.

9. The maze game of claim 1, further comprising a token piece sized to fit onto each of the regions.

10. The maze game of claim 1, said surfaces comprising a plurality of sheets.

11. The maze game of claim 10, comprising at least two game boards and two sheets, and two token pieces, each token piece sized to fit onto each of the regions.

12. The maze game of claim 4, wherein the partitions are sized so that adjacent inserted partitions are contiguous.

13. The maze of claim 12, wherein the partition receiving means comprises a network of grooves formed in the board defining said regions.

14. The maze game of claim 1, comprising at least two game boards and two surfaces, and two token pieces, each token piece being sized to fit onto each of the regions of the game boards.

15. The maze game of claim 1, comprising at least two of said game boards.

* * * * *